US006666267B1

(12) United States Patent
Charlton

(10) Patent No.: US 6,666,267 B1
(45) Date of Patent: Dec. 23, 2003

(54) DOWNHOLE TOOLS

(75) Inventor: Stephen Charlton, Bristol (GB)

(73) Assignee: Brunel Oilfield Services (UK) Limited, Bristol (GB)

( * ) Notice: Subject to any disclaimer, the term of this patent is extended or adjusted under 35 U.S.C. 154(b) by 0 days.

(21) Appl. No.: 09/554,400

(22) PCT Filed: Nov. 16, 1998

(86) PCT No.: PCT/GB98/03413

§ 371 (c)(1),
(2), (4) Date: Jul. 13, 2000

(87) PCT Pub. No.: WO99/25949

PCT Pub. Date: May 27, 1999

(30) Foreign Application Priority Data

Nov. 15, 1997 (GB) ..... 9724194

(51) Int. Cl.[7] ..... E21B 17/10

(52) U.S. Cl. ..... 166/241.6; 166/241.1; 175/325.3

(58) Field of Search ..... 166/170–176, 166/241.1, 222, 223, 242.1, 241.3, 241.4, 241.6; 175/325.1, 325.3

(56) References Cited

U.S. PATENT DOCUMENTS

| | | | | |
|---|---|---|---|---|
| 3,063,760 A | | 11/1962 | Gifford | |
| 4,088,185 A | * | 5/1978 | Carson | 166/176 |
| 4,796,670 A | | 1/1989 | Russell et al. | |
| 4,984,633 A | | 1/1991 | Langer et al. | |
| 5,095,981 A | | 3/1992 | Mikolajczyk | |
| 5,212,885 A | | 5/1993 | Buonodono et al. | |
| 5,318,805 A | | 6/1994 | Wu | |
| 5,575,333 A | | 11/1996 | Lirette et al. | |

FOREIGN PATENT DOCUMENTS

| | | |
|---|---|---|
| EP | 0138603 A2 | 4/1985 |
| EP | 0297716 A1 | 1/1989 |
| EP | 0671546 A1 | 9/1995 |
| GB | 682362 | 11/1952 |
| GB | 2226520 A | 7/1990 |
| GB | 2 249 333 A | 5/1992 |
| GB | 2275284 A | 8/1994 |
| GB | 2 282 615 A | 4/1995 |
| GB | 2 285 649 A | 7/1995 |
| GB | 2016063 A | 9/1995 |
| GB | 2 304 753 A | 3/1997 |
| WO | WO 91/0593 A1 | 5/1991 |
| WO | WO 95/21986 A1 | 8/1995 |
| WO | WO 96/34173 A1 | 10/1996 |
| WO | WO 97/08422 A1 | 3/1997 |
| WO | WO 98/37302 A1 | 8/1998 |

* cited by examiner

*Primary Examiner*—Frank Tsay
(74) *Attorney, Agent, or Firm*—Alston & Bird LLP

(57) ABSTRACT

A casing centralizer is provided. Such a casing centralizer includes a tubular body substantially comprised of a plastics material and having an innermost surface, an outermost surface, and opposed ends. The tubular body is adapted to surround a well casing and to centralize the well casing within it wellbore. The innermost surface of the tubular body defines at least one recess that extends longitudinally and radially tapers along at least a portion of the innermost surface. An associated wellbore casing apparatus, downhole tool, and method of cementing a well casing into a well bore are also provided.

39 Claims, 4 Drawing Sheets

Figure 5:
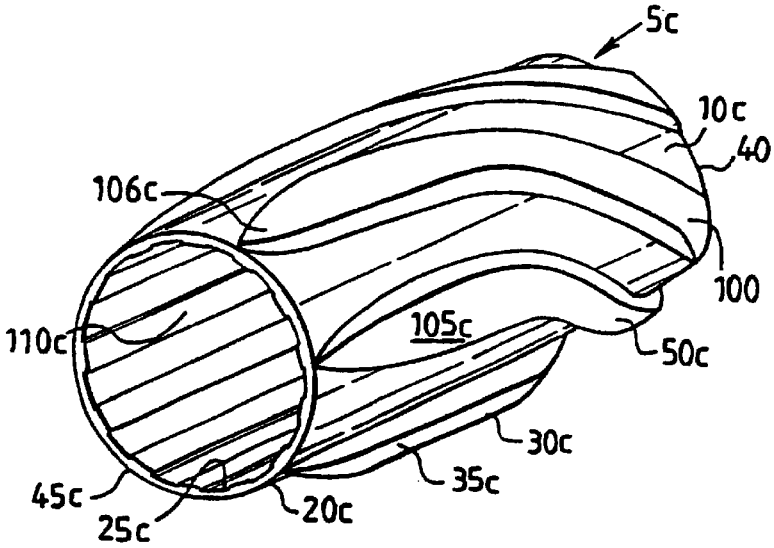

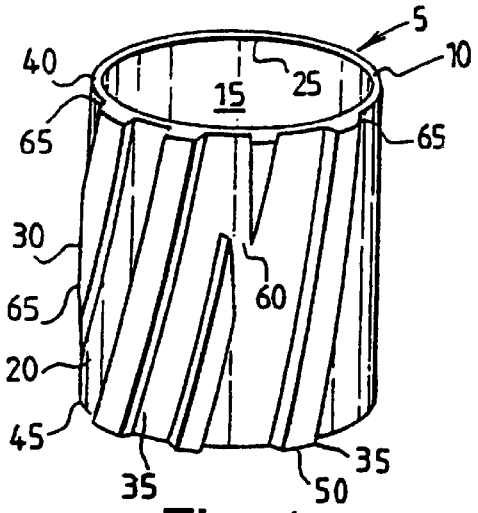
Fig. 1
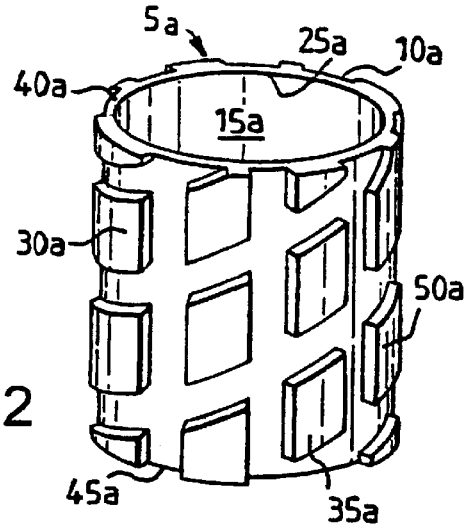
Fig. 2
Fig. 3
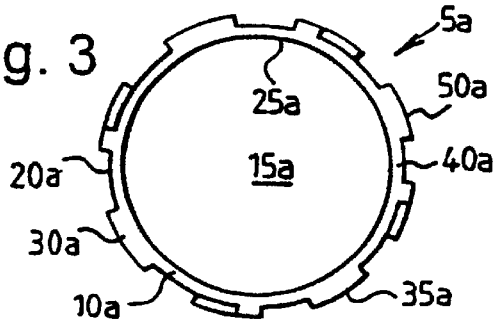
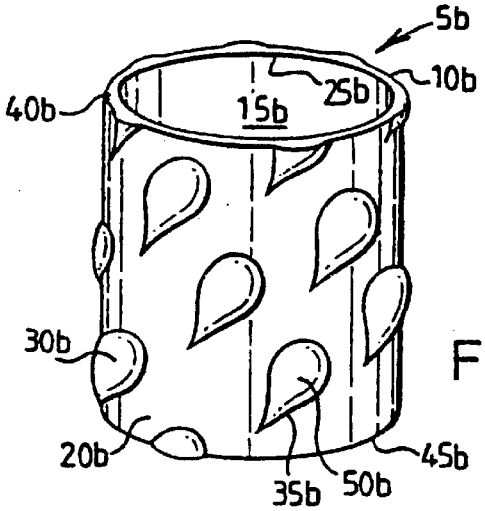
Fig. 4

DOWNHOLE TOOLS

BACKGROUND OF THE INVENTION

1. Field of the Invention

This invention relates to downhole tools; particularly, though not exclusively, to an improved casing centraliser; and more particularly, though not exclusively, to a casing centraliser for facilitating cementing of casing in a well.

2. Description of Related Art

After a well section has been drilled, it is necessary to secure a borehole of the well section by lining it with a pipe known as oilfield "casing" or "liner"—or generically "tubular".

Having installed the casing or liner within the borehole, it is necessary to make a seal in an annular space formed between the borehole and an outer surface of the pipe. This seal provides both a strengthening role forming a composite structure of the steel pipe and the seal itself, as well as a barrier to the possible flow of fluid contained in one geological strata to another to the surface at a well head. Such a seal is usually achieved by displacing the drilling fluid in which the pipe was run, and which is thus contained in the annular space, with a cement slurry which subsequently hardens forming an impermeable barrier or sheath.

The success of cementation operations is largely determined by the displacement efficiency of the cement slurry as it displaces drilling fluid from the annulus.

This displacement efficiency is maximised by a number of factors, these include "centralisation" of the pipe (i.e. aligning the axis of rotation—longitudinal axis—of the pipe with a centre of the borehole). This keeps the pipe off the borehole wall as much as possible. In addition reciprocation of the pipe where practicable; and the creation of a degree of turbulent flow in the annulus while pumping the slurry.

From the foregoing it is clear that pipe movement forms a critical role in securing a borehole after drilling operations, both in terms of getting the pipe to the bottom of the well, where drag forces are critical factors and in maximising the displacement efficiency of the cement slurry, in which rotational forces and centralisation are critical factors.

Boreholes are generally becoming deeper and more tortuous than ever before as Operators strive to access near field potential hydrocarbon reserves (i.e. marginal reserves close to existing infrastructure) in an effort to extend the life of their facilities. There is, therefore, a need in the industry to reduce the dynamic forces, drag and torque, required to secure the casing and liner in these boreholes thereby creating a competitive advantage over conventional equipment.

Known casing/liner centralisation and cementing accessories are made of metals such as steel, zinc and aluminium.

U.S. Pat. No. 5,095,981 (MIKOLAJCZYK) discloses a casing centralizer comprising a circumferentially continuous tubular metal body adapted to fit closely about a joint of casing, and a plurality of solid metal blades fixed to the body and extending parallel to the axis of the body along the outer diameter of the body in generally equally spaced apart relation, each blade having opposite ends which are tapered outwardly toward one another and a relatively wide outer surface for one another and a relatively wide outer surface for bearing against the well bore or an outer casing in which the casing is disposed, including screws extending threadedly through holes in at least certain of the blades and the body for gripping the casing so as to hold the centralizer in place.

WO 91/05093 (WEATHERFORD) discloses apparatus for use with a tubular member, which apparatus comprises: a generally cylindrical hollow body having an inner surface of substantially uniform diameter, an outer surface, a first end and a second end, and disposed on a tubular member a plurality of ribs extending from and spaced apart on said body, characterised in that the distance between at least one adjacent pair of ribs and/or the thickness of the generally cylindrical hollow body is not uniform throughout the length of the apparatus.

EP 0 671 546 A1 (DOWNHOLE PRODUCTS) discloses a casing centraliser comprising an annular body, a substantially cylindrical bore extending longitudinally through said body, and a peripheral array of a plurality of longitudinally extending blades circumferentially distributed around said body to define a flow path between each circumferentially adjacent pair of said blades, each said flow path providing a fluid flow path between longitudinally opposite ends of said centraliser, each said blade having a radial outer edge providing a well bore-contacting surface, and said cylindrical bore through said body being a clearance fit around tubular casing intended to be centralised by said casing centraliser, the centraliser being manufactured from a material which comprises zinc and preferably a zinc alloy.

The content of the abovementioned prior art citations is incorporated herein by reference.

BRIEF SUMMARY OF THE INVENTION

It is an object of one or more aspects of the present invention to obviate or mitigate problems in the prior art.

It is a further object of one or more aspects of the present invention to seek to meet the aforementioned industry need.

According to a first aspect of the present invention there is provided a casing centraliser at least a portion of at least one surface of which is selected from a material comprising a plastics material or a ceramic material, cermet or submicron grained cemented carbide.

Each material has a number of advantages over the other.

Advantageously the plastics material may be a polymer of carbon monoxide and alpha-olefins, such as ethylene.

Advantageously the material may be an aliphatic polyketone made prom co-polymerisation of ethylene and carbon monoxide—optionally with propylene.

Advantageously the material may be CARILON (Trade Mark) available from Shell Chemicals. CARILON (Trade Mark) is a class of semi-crystalline thermoplastic materials with an alternating olefin—carbon monoxide structure.

Alternatively the plastics material may be a nylon resin.

Advantageously the plastics material may be an ionomer modified nylon 66 resin.

Advantageously the plastics material may be ZYTEL (Trade Mark) available from Du Pont. ZYTEL (Trade Mark) is a class of nylon resins which, includes unmodified nylon homopolymers (e.g. PA 66 and PA612) and copolymers (e.g. PA 66/6 and PA 6T/MPMDT, etc.) plus modified grades produced by the addition o heat stabilizers, lubricants, ultraviolet screens, nucleating agents, tougheners, reinforcements, etc. The majority of resins have molecular weights suited for injection moulding and some are used in extrusion.

Alternatively the plastics material is VESCONITE (Trade Mark) available from Vesco Plastics Australia Pty Ltd.

Alternatively the material may be polytetrafluoroeth(yl) ene (PTFE).

In such case the material may be TEFLON.

The ceramic material may be, for example, zirconia, titania and/or alumina. The ceramic material may be toughened by addition of a further material, for example zircoria with the addition of alumina.

The casing cencraliser may comprise a tubular body.

The tubular body may have a bore extending longitudinally therethrough.

The body may provide an outermost surface and an innermost surface.

The outermost surface may provide a plurality of raised portions.

The raised portions may be in the form of longitudinally extending blades or ribs or may alternatively be in the form of an array of nipples.

Adjacent raised portions may define a flow path therebetween such that fluid flow paths are defined between first and second ends of the tubular body.

Where the raised portions comprise longitudinal blades, such blades may be formed substantially parallel to an axis of the tubular body.

Alternatively, the blades may be formed in a longitudinal spiral/helical path on the tubular body.

Advantageously adjacent blades may at least partly longitudinally overlap on the tubular body.

Preferably adjacent blades may be located such that one end of a blade at one end of the tubular body is at substantially the same longitudinal position as an end of an adjacent blade at another end of the tubular body.

More preferably, the blades may have an upper spiral section, a middle substantially straight portion and a lower tapered portion.

Each raised portion may provide a wellbore contacting surface.

The bore through the body may be a clearance fit around a tubular casing intended to be centralised by the centraliser.

In one embodiment the outermost and/or innermost surfaces of the centraliser may be selected from a plastics material or a ceramic material, cermet or submicron grained cemented carbide, and advantageously comprise CARILON In such an embodiment the outermost and/or innermost surfaces may comprise a coating formed on an inner tubular body.

The inner tubular body may be made of a metallic material such as steel, zinc, zinc alloy, or preferably from aluminium or aluminium alloy.

In a further, preferred embodiment the body may be made from a material selected from a plastic material or a ceramic material, and advantageously may be CARILON.

The casing centraliser according to the first aspect of the present invention may be formed from a casting process.

Alternatively and advantageously the casing centraliser according to the first aspect of the present invention may be formed from an injection moulding process.

Advantageously the casing centraliser may be formed with the innermost surface providing at least one and preferably a plurality of spaced apart longitudinally extending tapered recesses. The recess(es) may taper from an upper end towards a lower end of the centraliser.

According to a second aspect of the present invention there is provided a wellbore casing apparatus including a well casing and at least one casing centraliser located thereupon, wherein at least a portion of at least one surface of the centraliser is selected from a material comprising a plastics material or a ceramic material, cermet or submicron grained cemented carbide.

The well casing is preferably of a hollow tubular form.

Further the at least one centraliser may comprise a tubular body.

The at least one centraliser may be located so as to surround the casing.

The at least one centraliser may be located relative to the casing by means of a collar.

The at least one centraliser may be located relative to the casing and may be rotatable relative to the casing along a longitudinal axis thereof.

According to a third aspect of the present invention there is provided a method of cementing a well casing into a well bore, the method comprising the steps of:

providing a well casing;

providing at least one casing centraliser, the/each centraliser comprising at least a portion of at least one surface of which is selected from a material comprising a plastics material or a ceramic material, cermet or submicron grained cemented carbide;

locating the at least one centraliser on the casing a desired position so as to provide a casing apparatus;

placing the casing apparatus with the borehole;

pumping cement into an annular space between an exterior of the casing and the wellbore.

According to a fourth aspect of the present invention there is provided a downhole device/apparatus/tool at least a portion of at least one surface of which is selected from a material comprising a plastics material or a ceramic material, cermet or submicron grained cemented carbide.

Each material provides a number of advantages over the others.

The downhole device/apparatus/tool may be, for example, a casing, a casing centraliser, a protector, a stabiliser, a liner/a glider, and/or a turbulating clamp, an anti-casing war device such as a non-rotating drill pipe protector or sacrificial wear bushing, a logging/wireline conveyed tool/tool string, and/or a control line clamp for the purpose of actuating downhole safety devices, gauges and/or pumps.

Advantageously the material may be a thermoplastic polymer.

Advantageously the material may be polymer of carbon monoxide and alpha-olefins, such as ethylene.

Advantageously the material may be an aliphatic polyketone made from co-polymerisation of echylene and carbon monoxide—optionally with propylene.

Advantageously the material may be CARILON (Trade Mark) available from Shell Chemicals. CARILON (Trade Mark) is a class of semi-crystalline thermoplastic materials with an alternating olefin—carbon monoxide structure.

Alternatively the material may be polytetrafluoroeth(yl) ene) (PTFE).

In such case the material may be TEFLON.

The ceramic material may be, for example, zirconia, titania and/or alumina. The ceramic material may be toughened by addition of a further material, for example zirconia with the addition of alumina.

The device may comprise a main body.

The main body may comprise or be at least partially coated with the material.

According to a fifth aspect of the present invention there is provided a casing centraliser comprising a tubular body having an outermost surface carrying a plurality of raised nipple portions.

The plurality of raised nipple portions may comprise an array of portions, adjacent portions being substantially equally spaced around the outermost surface.

According to a sixth aspect of the present invention there is provided a casing centraliser comprising an outermost surface, the outermost surface providing a plurality of raised portions, the raised portions are in the form of longitudinally extending blades or ribs, the blades or ribs are formed in a longitudinal spiral/helical path on a tubular body wherein adjacent blades are located such that the top of a blade at a first end of the tubular body is at the same longitudinal position as the bottom of an adjacent blade at a second end of the tubular body.

Preferably the blades or fins have an upper spiral section, a middle substantially straight portion and a lower tapered portion.

According to a seventh aspect of the present invention there is provided a casing centraliser at least a portion of at least one surface of which is coloured wherein the colour identifies an outer and/or inner diameter of the casing centraliser.

According to an eight aspect of the present invention there is provided a colour coded set of casing centralisers comprising a plurality of casing centraliser, each casing centraliser has at least a portion of at least one surface coloured wherein the colour identifies an outer and/or inner diameter of the casing centraliser.

According to a ninth aspect of the present invention there is provided a casing centraliser composing a radioactive element, wherein the radioactive element is traceable to reveal the position of the casing centraliser when located in a wellbore.

One or more of the nipple portions may be substantially parallelogram or diamond shaped.

Adjacent raised nipple portions may define a flow path therebetween such that a fluid (cement) flow pth/paths are defined between first and second ends of the tubular body.

BRIEF DESCRIPTION OF THE SEVERAL VIEWS OF THE DRAWING(S)

Figure 6:
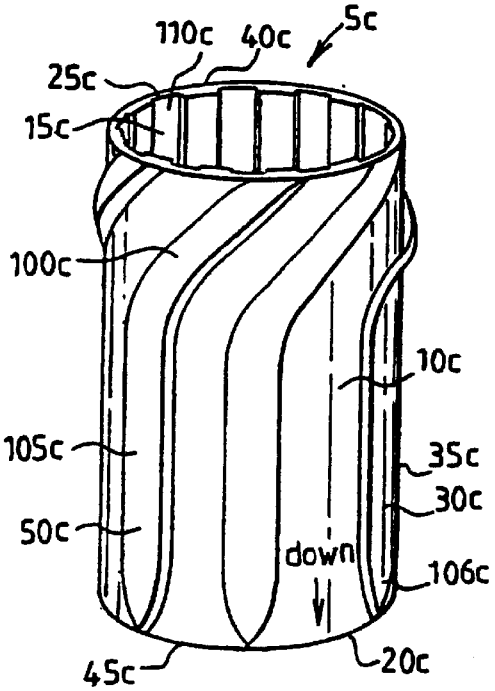
Figure 7:
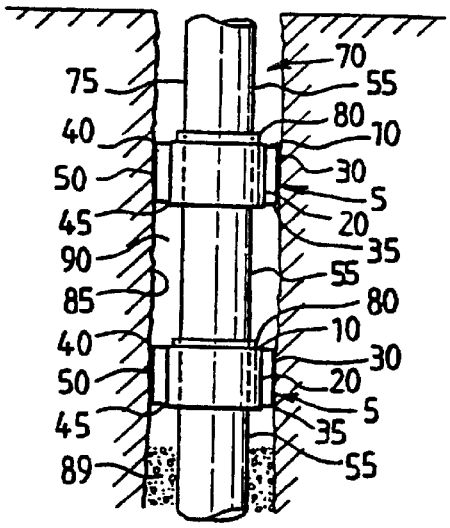
Figure 8A:
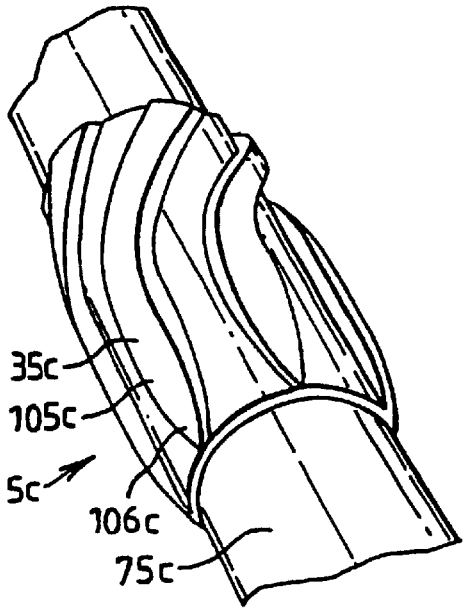
Figure 8B:
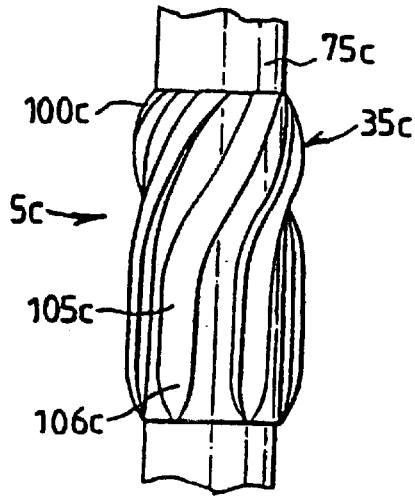
Figure 9:
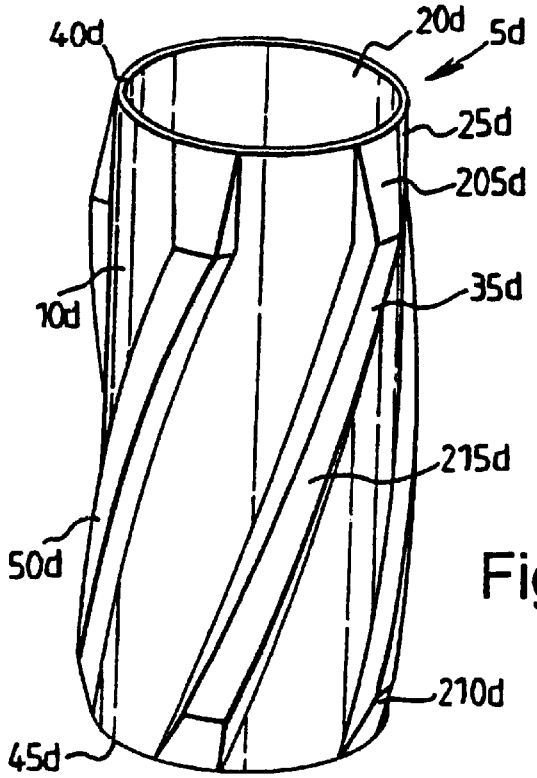
Figure 10:
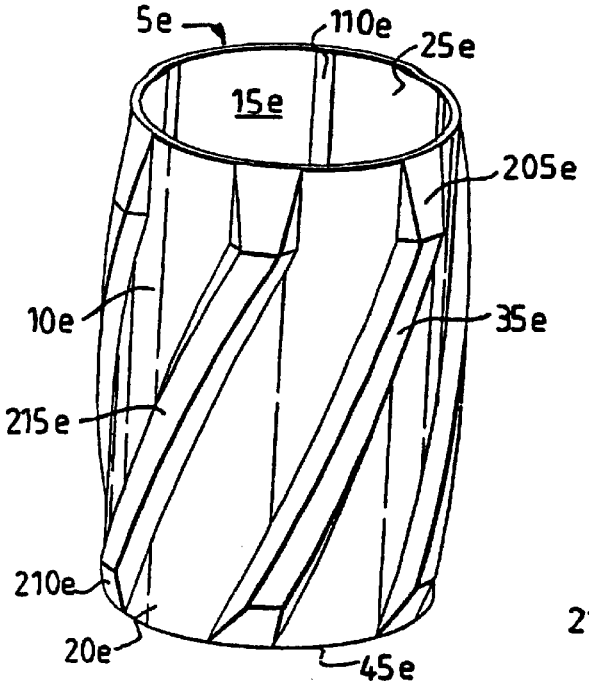
Figure 11:
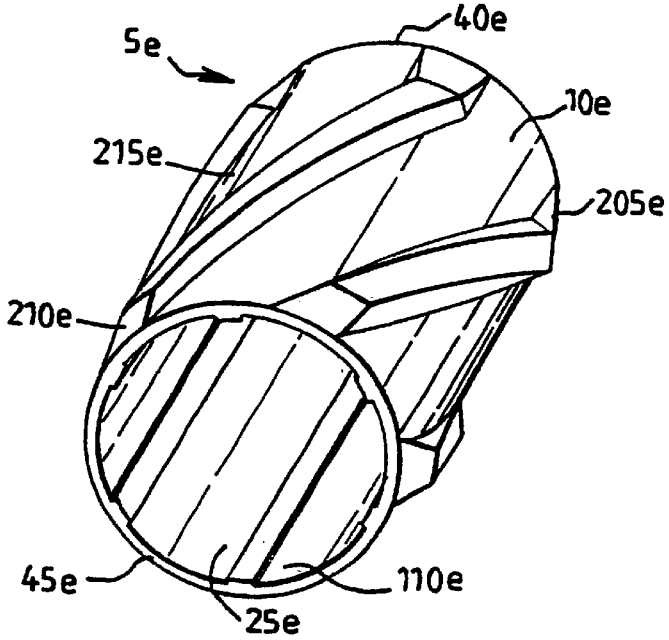

Embodiments of the present invention will now be described, by way of example only, with reference to the accompanying drawings, which are:

FIG. 1 a perspective view from one side and above of a first embodiment of a casing centraliser according to the present invention;

FIG. 2 a perspective view from one side and above of a second embodiment of a casing centraliser according to the present invention;

FIG. 3 a top view of the casing centraliser of FIG. 3;

FIG. 4 a perspective view from one side and above of a third embodiment of a casing centraliser according to the present invention;

FIG. 5 a perspective view from one side and below of a fourth embodiment of a casing centraliser according to the present invention;

FIG. 6 a perspective view from one side and above of the casing centraliser of FIG. 5;

FIG. 7 a schematic side view of a wellbore having a casing apparatus including casing centralisers according to the present invention;

FIGS. 8(*a*) and (*b*) a perspective view from one side and above and a view from one side respectively of the casing centraliser of FIG. 5 positioned relative to a casing;

FIG. 9 a perspective view from one side and above of a fifth embodiment of a casing centraliser according to the present invention;

FIG. 10 a perspective view from one side and above of a sixth embodiment of a casing centraliser according to the present invention;

FIG. 11 a perspective view from one side and below of the casing centraliser of FIG. 10, and FIG. 12 a cross-sectional view of a casing centraliser and casing according to a seventh embodiment of the present invention.

DETAILED DESCRIPTION OF THE INVENTION

Referring to FIG. 1, there is shown a first embodiment of a casing centraliser, generally designated 5, according to the present invention. At least a portion of at least one surface of the casing centraliser 5 is selected from a material advantageously providing a good tribiological performance and comprising a plastics material or a ceramic material, cermet or submicron grained carbide. In this embodiment the material is a thermoplastic polymer, particularly a polymer of carbon monoxide and alpha-olefins, and more particularly CARILON (Trade Mark) available from Shell Chemicals, as will hereinafter be discussed in greater detail. In an alternative embodiment the material is polytetrafluoroeth(yl)ene (PTFE), and particularly TEFLON. In a further alternative embodiment the material is a ceramic material, for example selected from zirconia, titania and/or alumina perhaps toughened with titanium carbide, or alternatively a titanium based ceramic, perhaps with additions of aluminium/boron and nitrogen, or alternatively silicon nitride.

The casing centraliser 5 comprises a tubular body 10. The tubular body 10 has a bore 15 extending longitudinally therethrough. The body 10 is provided with an outermost surface 20 and an innermost surface 25. The outermost surface 20 is provided with a plurality of raised portions 30. In this embodiment the raised portions 30 are in the form of longitudinally extending blades, ribs or flutes 35.

Adjacent blades 35 define a flow path therebetween such that a fluid (concrete) flow path/paths are defined between first and second ends 40, 45 of the tubular body 10.

In his embodiment the blades 35 are formed in a longitudinal spiral path around the tubular body 10. In an alternative embodiment the blades 35 may be formed substantially equally spaced one from the other and substantially parallel to an axis of the tubular body 10.

Each blade 35 provides a wellbore contacting/bearing surface 50.

As can best be seen from FIG. 7, bore 15 through the body 10 is a clearance fit around a tubular basing 55 intended to be centralised by the centraliser 5.

In this embodiment the body 10 including blades 35 is made from a material selected from a plastics material or a ceramics material, cermet or submicron grade carbide, and particularly CARILON (Trade Mark).

In an alternative embodiment the outermost and/or innermost surfaces 20, 25 of the centraliser 5 may be selected from a plastics material or a ceramic material, cermet or submicron grained cement carbide, and advantageously comprise CARILON. In such an embodiment the outermost and/or innermost surfaces 20, 25 may comprise a coating formed on an inner tubular body. The inner tubular body may be made of a metallic material such as steel, zinc, zinc alloy, or preferably from aluminium or aluminium alloy.

CARILON (Trade Mark) is a semi-crystalline aliphatic polyketone as disclosed in Shell Chemical Literature available from their web-site bttp://www.shellchemical.com as at Nov. 10th, 1998 and included herein by reference.

According to the literature CARILLON (Trade Mark) is characterised by the following:

Short moulding cycles and good mould definition

Low warpage and no need for post-moulding conditioning

Superior resilience and snapability

Very good impact performance over a broad temperature range very good chemical resistance and barrier performance Very good hydrolytic stability Good friction/wear characteristics and low noise generation A range of CARILON (Trade mark) is used depending on the performance required and the fabrication method i.e. extrusion or injection moulding. The current range is:

SC:2544-97—CARILON® D26CX100—Advanced extrusion grade

SC:2545-97—CARILON® D26FX100—General-purpose extrusion grade

SC:2546-97—CARILON® D26HM100—General-purpose injection moulding grade

SC:2547-97—CARILON® D26VM100—High-flow injection moulding grade.

SC:2548-97—CARILON® DB6G3A10—15% Glass-reinforced general-purpose injection moulding grade SC:2549-97—CARILON® DB6GA10—30% Glass-reinforced general-purpose injection moulding grade SC:2550-97—CARILON® DB6F0A10—Flame-retarded (V-0), injection moulding grade SC:2551-97—CARILON® DB6F5G40—Flame-recarded (V-0), 20% grass-reinforced, injection moulding grade SC:2552-97—CARILON® DB6F1G30—Flame-retarded (V-1), tracking-resistant, 15% glass-reinforced, injection moulding grade SC:2533-97—CARILON® DA6L1A10—Lubricated injection moulding grade SC:2554-97—CARILON® DA6P2L10—High-performance lubricated injection moulding grade SC:2557-97—CARILON® DB6G6P30—Lubricated, glass-reinforced, injection moulding grade For some environments ZYTEL (Trade Mark) can be used. ZYTEL (Trade Mark) is a nylon resin available from Du Pont which can be injection moulded, and is disclosed on their web-size http://www.dupont.com as at Nov. 12th 1998, included herein by reference. Currently thirteen grades of ZYTEL (Trade Mark) can be used, namely:

408L NC0 Ionomer modified nylon 66 resin

450HSL BK 152 Olefinic/rubber modified nylon 66 resin

3189 NC010 Cube blend, stiff, rubber modified nylon 66 resin

FN718 NC010 Flexible, grafted ionomer modified nylon 66 resin

FN714 NC010 Very flexible, grafted ionomer modified nylon 66 resin

CFE4003HS BK245 Heat Stabilized, toughened black nylon 66 resin

CFE4004HS NC010 Heat Stabilized, toughened nylon 66 resin

CFE4005HS BK246 Het Stabilized, highly toughened black nylon 66 resin

CFE4006HS NC010 Heat Stabilized, highly toughened nylon 66 resin which are toughened nylons and ST801 NC010 Grafted rubber modified nylon 66 resin ST801W NC010 Grafted rubber modified nylon 66 resin ST801W BK195 Grafted rubber modified nylon 66 resin ST901L NC010 Grafted rubber modified amorphous nylon resin which are super tough nylons.

A further alternative plastics material which is used in VESCONITE (Trade Mark). It is available from Vesco Plastics Australia Pty Ltd. VESCONITE (Trade Mark) exhibits greater hardiness, lower friction, negligible water absorption and higher chemical resistance than nylon. VESCONITE (Trade Mark) can be machined. Of better quality is VESCONITE HILUBE (Trade Mark) which can be injection moulded.

The casing centraliser 5 according to the present invention may advantageously be formed from an injection moulding process. Alternatively the casing centraliser 5 according to the present invention may be formed from a casting process.

The casing centraliser 5 illustrated in FIG. 1 is fabricated from an injection moulding process. In order to facilitate ease of fabrication by injection moulding it should be noted that one of the blades 35 is formed with a gap 60 for provision of a moulding split-line. It is further noted that side edges 65 of each of the blades 35 of the casing centraliser 5 are substantially parallel to one another again for provision of a moulding split-line.

As mentioned hereinbefore, in this embodiment the body 10 including raised portions 30 is made from CARILON (Trade Mark). CARILON (Trade Mark) thermoplastic polymers are a category of performance polymers available from Shell Chemicals, comprising polymers of carbon monoxide and alpha-olefins, such as ethylene, having linear alternating structures known as aliphatic polyketones (PK). CARILON (Trade Mark) provides a good balance of mechanical properties, low wear, chemical/fuel resistance and efficient processing, exhibiting good hydrolythic stability and low moisture absorption. Further it provides good tribiological properties.

Referring now to FIG. 7, in use, the casing centraliser 5 forms part of a wellbore casing apparatus 70.

The wellbore casing apparatus 70 includes a well casing 75 and at least one casing centraliser 5 located thereupon. The well casing 75 is of a hollow tubular form. The at least one centraliser 5 is located so as to surround the casing 75. The at least one centraliser 5 is located relative to the casing by means of a stop collar 80, as is known in the art. In this embodiment the at least one centraliser is located relative to the casing and is rotatable relative to the casing by means of collar 80 along a longitudinal axis thereof.

In use, the well casing 75 is cemented into a well bore 85, by the following method steps of:

providing a wellbore 85;

providing a well casing 75;

providing at least one casing centraliser 5;

locating the at least one centraliser 5 on the casing 75 at a desired position so as to provide a casing apparatus 70;

placing the casing apparatus 70 within the borehole 85;

pumping cement 89 into an annular space 90 between an exterior of the casing 75 and the wellbore 85.

The cement 89 may be pumped down an inside of the well casing 75 and thence up the annular space 90 so as to remove drilling fluid from the borehole 85, as is known in the art.

In this way the centraliser(s) 5 position the casing 75 within the wellbore 90 by means of raised portions 30—in this embodiment blades 35—the contacting surface 50 of which abut the wellbore 90 wall where required. This suitably provides annular space 90 for cementation of the casing apparatus 70 within the wellbore 85.

Referring now to FIGS. 2 and 3, there is shown a second embodiment of a casing centraliser, generally designated 5*a* according to the present invention. Like parts of the casing centraliser 5*a* are identified by the same numerals as in the casing centraliser 5 but suffixed with "a".

In the centraliser 5*a* the outermost surface 20*a* is provided with a plurality of raised portions 30*a* in the form of an array of substantially equally spaced nipples 35*a*. The nipples 35*a* are, in this embodiment, of substantially diamond or parallelogram shape. The precise shape and dimensions of the nipples 35*a* may be designed to achieve a "flow by" and "bearing surface" optimum efficiency.

Referring now to FIG. 4, there is illustrated a third embodiment of a casing centraliser, generally designated 5*b* according to the present invention. Like parts of the casing centraliser 5*b* are identified by the same numerals as in the casing centraliser 5 but suffixed with "b".

In the centraliser 5*b* the outermost surface 20*b* is provided with a plurality of raised portions 30*b* in the form of an array of substantially equally spaced nipples 35*b*. The nipples 35*b* are, in this embodiment, of substantially inverted inclined teardrop shape. The precise shape and dimensions of the nipples 35*b* may be designed to achieve a "flow by" and "bearing surface" of optimum efficiency.

Referring now to FIGS. 5, 6 and 8 there is illustrated a fourth embodiment of a casing centraliser, generally designated 5*c*, according to the present invention. Like parts of the casing centraliser 5*c* are identified by the same numerals as in the casing centraliser 5 but suffixed with "c".

In the centraliser 5*c* the blades/flutes 35*c* have an upper spiral portion 100*c* and a middle substantially straight portion 105*c*, and a lower tapered portion 106. This blade 35*c* is novel in itself and provides various advantages to known blade designs.

The inner surface 25*c* of the centraliser 5*c* is further provided with a plurality of circumferentially spaced apart longitudinally extending tapered recesses 110*c*. In this embodiment the recesses 110*c* taper from the upper end 40*c* towards the lower end 45*c*. The recesses 110*c* facilitate ease of release of the centraliser 5*c* from a mould during manufacture where the centraliser 5*c* is made from moulding techniques such as injection moulding.

Referring now to FIG. 9 there is illustrated a fifth embodiment of a casing centraliser, generally designated 5*d*. Like parts of the casing centraliser 5*d* are identified by the same numerals as in the casing centraliser 5 but suffixed with "d".

In this embodiment the blades 35 comprise three sections. Upper and lower sections, 205*d*, 210*d*, have outer surfaces which taper from the full height of the blade 35*d* to the tubular body 10*d* on its outer surface 25*d*. Upper sections 205*d* of all blades 35*d* are substantially parallel. Similarly lower sections 210*d* of all blades 35*d* are substantially parallel. The centre portion 215*d* is substantially trapezoidal in cross-section. The centre portion 215*d* defines a helical path around the tubular body 10*d*. Five blades 35*d* are equally spaced around the tubular body 10*d*.

Referring now to FIGS. 10 and 11, there is illustrated a sixth embodiment of a casing centraliser, generally designated 5*e*, according the present invention. Like parts of the casing centraliser 5*e* are identified by the same numerals as in the casing centraliser 5 but suffixed with "e". Casing centraliser 5*e* has an outermost surface 20*e* and an innermost surface 25*e*. Raised portions on the outermost surface 20*e* are identical to those of the fifth embodiment in FIG. 9, and are labelled accordingly. The innermost surface 25*e* has recesses as illustrated in the fourth embodiment, FIG. 5

Figure 12:
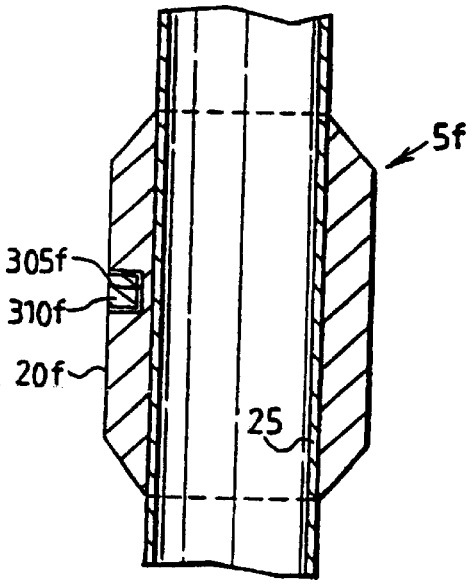

Reference is now made to FIG. 12 of the drawings, there is shown a seventh embodiment of a casing centraliser, generally designated 5*f* according to the present invention. Like parts of the casing centraliser 5*f* are identified by the same numerals as in the casing centraliser 5 but suffixed with "f".

In the casing centraliser 5*f* the outermost surface 20*f* is provided with a recessed portion 305*f*. Within the recessed portion 305*f* is contained a plug 310*f*. The plug 310*f* which is typically made from the same material as the centraliser may be painted with a radioactive element, e.g. α-source on a outer surface. This facilitates the use of a radioactive detector for determining the position of the casing centraliser 5*f* within the wellbore. Additionally the signal from the radioactive element comprising the plug 310*f* can be used to provide a depth indicator for logging purposes.

The centraliser casings illustrated may all be coloured. This may be achieved by coating a surface of the centraliser or, preferably, dyeing the plastic or ceramic material before fabrication. The dye may comprise a nylon base and may be approximately 2% of the centraliser material and does not contain heavy metal or diraylide. The colour selected may indicate the outer or inner diameter of the casing centraliser. In a preferred embodiment the CARILLON (Trade Mark) is dyed with β-Carotene (available from Aldrich Chemical, Dorset, England) to give an orange coloured casing centraliser. The orange centraliser may have an inner diameter of approximately 3½ inches, to give a clearance fit on a 3½ inch O.D. casing, pipe or tubing. Similarly a casing centraliser coloured red could be sized to fit a casing with an O.D. of 2⅞ inches and a yellow casing centraliser could be sized to give a clearance fit to a casing of 4 inch O.D. Colouring the casing centraliser provides easy identification and facilitates ease in accessing quantities available at a drill site.

It will be appreciated by those skilled in the art that the embodiments of the invention hereinbefore described are given by way of example only, and are not meant to limit the scope of the invention in any way. It is noted that the term centraliser has been used herein; however it will be appreciated that the device also acts as a "liner glider".

In particular it should be appreciated that:

a) The use of low friction materials such as plastics, Teflon, composites and ceramics will significantly improve the effectiveness of current borehole securing operations and extend their scope by offering operators the opportunity to run casings and liners in deeper and more tortuous wells than has hitherto been possible. This reduces the drag/frictional forces thus allowing the pipe to reach the desired depth and desired rotational speeds. These materials can be formed into devices that can be fitted externally onto the pipes prior to installation.

B) The use of low friction laminates and coatings such as plastic, Teflon, composites and ceramics will significantly enhance the performance of existing metal oilfield equipment, by reducing the drag/frictional forces thus allowing the pipe to reach the desired depth and desired rotational speeds.

C) The use of plastic, Teflon or composite material will prolong the life of wells due to the lack of galvanic corrosion associated with the use of dissimilar metals in saline environments.

D) The use of plastic or composite makes kit lighter in weight, which makes for easier installation and means that the device will float in certain drilling fluids.

E) Design may be used in other downhole equipment to enhance efficiency, as will the use of ceramics or Teflon, e.g. stabilisers in drilling operations.

What is claimed is:

1. A casing centralizer, comprising:

a tubular body substantially comprised of a plastics material and having an innermost surface, an outermost surface, and opposed ends, the tubular body being adapted to surround a well casing and to centralize the well casing within a wellbore, the innermost surface of the tubular body defining at least one recess having a depth and extending longitudinally along at least a portion of the innermost surface between a first location and a second location, the recess radially tapering from the first location to the second location such that the depth of the recess at the first location is greater than the depth of the recess at the second location.

2. A casing centralizer as claimed in claim 1, wherein the outermost surface further comprises at least one wellbore contacting surface.

3. A casing centralizer as claimed in claim 2, wherein at least a portion of the at least one wellbore contacting surface is substantially comprised of the plastics material.

4. A casing centralizer as claimed in claim 2, wherein the outermost surface has at least one blade integrally formed therewith and extending outwardly therefrom, the at least one blade extending longitudinally along the outermost surface and comprising the at least one wellbore contacting surface.

5. A casing centralizer as claimed in claim 1, wherein the plastics material comprises carbon monoxide and alpha-olefin.

6. A casing centralizer as claimed in claim 5, wherein die plastics material further comprises ethylene.

7. A casing centralizer as claimed in claim 1, wherein the plastics material comprises an aliphatic polyketone made from co-polymerization of ethylene and carbon monoxide, optionally with propylene.

8. A casing centralizer as claimed in claim 1, wherein the plastics material comprises a semi-crystalline thermoplastic material having an alternating olefin-carbon monoxide structure.

9. A casing centralizer as claimed in claim 1, wherein the plastics material comprises a nylon resin.

10. A casing centralizer as claimed in claim 9, wherein the plastics material further comprises an ionomer modified nylon 66 resin.

11. A casing centralizer as claimed in claim 9, wherein the plastics material is selected from the group consisting of an unmodified nylon homopolymer, a copolymer thereof, and a modified grade thereof, each optionally including an additive selected from the group consisting of a heat stabilizer, a lubricant, an ultraviolet screen, a nucleating agent, a toughener, a reinforcement, and combinations thereof.

12. A casing centralizer as claimed in claim 1, wherein the plastics material comprises polytetrafluoroethene.

13. A casing centralizer as claimed in claim 1, wherein the outermost surface has a plurality of raised portions integrally formed therewith and extending outwardly therefrom.

14. A casing centralizer as claimed in claim 13, wherein the raised portions further comprise at least one of blades and ribs extending longitudinally along the outermost surface.

15. A casing centralizer as claimed in claim 14, wherein at least one of the raised portions is configured to extend longitudinally along the outermost surface in substantially parallel relation to an axis of the tubular body.

16. A casing centralizer as claimed in claim 14, wherein at least one of the raised portions is configured to extend longitudinally along the outermost surface in at least one of a spiral path and a helical path.

17. A casing centralizer as claimed in claim 16, wherein adjacent ones of the raised portions are configured to at least partly overlap along the outermost surface.

18. A casing centralizer as claimed in claim 14, wherein adjacent ones of the raised positions are configured such that an end of a first raised portion at one end of the tubular body is substantially longitudinally aligned with an end of an adjacent second raised portion at the other end of the tubular body.

19. A casing centralizer as claimed in claim 14, wherein each raised portion is configured to have an upper section longitudinally spiralling along the outer surface from one end of the tubular body, a contiguous middle portion extending in a substantially straight manner along the outer surface, and a contiguous lower portion tapering toward the other end of the tubular body.

20. A casing centralizer as claimed in claim 13, wherein the raised portions further comprise an array of nipples.

21. A casing centralizer as claimed in claim 13, wherein adjacent ones of the raised portions define a flow path therebetween, the flow paths cooperating to define at least one fluid flow path between the opposed ends of the tubular body.

22. A casing centralizer as claimed in claim 13, wherein each raised portion further comprises a wellbore contacting surface.

23. A casing centralizer as claimed in claim 1, wherein the tubular body defines a bore extending therethrough, the bore being configured in a clearance fit with respect to the well casing.

24. A casing centralizer as claimed in claim 1, wherein the at least one recess further comprises a plurality of recesses circumferentially spaced apart about the innermost surface, each of the plurality of recesses extending longitudinally along at least a portion of the innermost surface.

25. A casing centralizer as claimed in claim 1, wherein the at least one recess substantially extends from one end to the other end of the tubular body.

26. A casing centralizes as claimed in claim 1, wherein the tubular body is formed in an injection molding process.

27. A wellbore casing apparatus, comprising:

a well casing; and at least one casing centralizer located on the well casing, each casing centralizer including a tubular body substantially comprised of a plastics material and having an innermost surface, an outermost surface, and opposed ends, the tubular body being configured to surround the well casing and adapted to centralize the well casing within a wellbore, the innermost surface of the tubular body defining at least one recess having a depth and extending longitudinally along at least a portion of the innermost surface between a first location and a second location, the recess radially tapering from the first location to the second location such that the depth of the recess at the first location is greater than the depth of the recess at the second location.

28. A wellbore casing apparatus as claimed in claim 27, wherein the well casing is configured to be tubular.

29. A wellbore casing apparatus as claimed in claim 27, further comprising a collar configured to be operably engageable with the well casing so as to locate the at least one casing centralizer along the well casing.

30. A wellbore casing apparatus as claimed in claim 27, wherein the at least one casing centralizer is located along the well casing and is configured to be rotatable about the well casing.

31. A downhole tool, comprising:

a tubular body substantially comprised of a plastics material and having an innermost surface, an outermost surface, and opposed ends, the innermost surface of the tubular body defining at least one recess having depth and extending longitudinally along at least a portion of the innermost surface between a first location and a second location, the recess radially tapering from the first location to the second location such that the depth of the recess at the first location is greater than the depth of the recess at the second location.

32. A downhole tool as claimed in claim 31, wherein the tubular body is configured as at least one of a casing, a casing centralizer, a stabilizer, a liner, a glider, a turbulating clamp, an anti-casing wear device, a non-rotating drill pipe protector, a sacrificial wear bushing, a logging conveyed tool, a wireline conveyed tool, a logging tool string, a wireline tool string, and a control line clamp.

33. A downhole tool as claimed in claim 31, wherein the plastics material comprises a thermoplastic polymer.

34. A downhole tool as claimed in claim 31, wherein the plastics material comprises carbon monoxide and alpha-olefin.

35. A downhole tool as claimed in claim 34, wherein the plastics material comprises ethylene.

36. A downhole tool as claimed in claim 34, wherein the plastics material comprises an aliphatic polyketone made from co-polymerization of ethylene and carbon monoxide, optionally with propylene.

37. A downhole tool as claimed in claim 31, wherein the plastics material comprises a semi-crystalline thermoplastic material having an alternating olefin—carbon monoxide structure.

38. A downhole tool as claimed in claim 31, wherein the material comprises polytetrafluoroethlene.

39. A downhole device comprising a downhole centralizer such as a casing centralizer, comprising:

a tubular body substantially comprised or a plastics material and having an innermost surface, an outermost surface, and opposed ends, the tubular body being adapted to surround a downhole tubular such as a well casing and to centralize the downhole tubular within a wellbore, the innermost surface of the tubular body defining at least one recess extending longitudinally and radially tapering longitudinally along at least a portion of the innermost surface.

* * * * *